US006981897B2

(12) United States Patent
Sakatani

(10) Patent No.: US 6,981,897 B2
(45) Date of Patent: Jan. 3, 2006

(54) WATERPROOF CONSTRUCTION FOR A GROUND TERMINAL FITTING, A METHOD AND AN APPARATUS FOR WATERPROOFING A GROUND TERMINAL FITTING

(75) Inventor: Atsushi Sakatani, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/864,959

(22) Filed: Jun. 10, 2004

(65) Prior Publication Data

US 2004/0253871 A1 Dec. 16, 2004

(30) Foreign Application Priority Data

Jun. 13, 2003 (JP) ..... 2003-169372

(51) Int. Cl.
*H01R 13/58* (2006.01)

(52) U.S. Cl. ..... 439/606; 439/275

(58) Field of Classification Search ..... 439/606, 439/604, 936
See application file for complete search history.

(56) References Cited

U.S. PATENT DOCUMENTS

| | | | | |
|---|---|---|---|---|
| 6,482,021 | B2 * | 11/2002 | Hara et al. | 439/279 |
| 6,613,263 | B2 | 9/2003 | Kondo | 264/263 |
| 2004/0092164 | A1 * | 5/2004 | Lee | 439/606 |

* cited by examiner

*Primary Examiner*—Hae Moon Hyeon
(74) *Attorney, Agent, or Firm*—Gerald E. Hespos; Anthony J. Casella

(57) ABSTRACT

Jigs (26, 30) are provided in a mold (22) for holding a plurality of wires (17*a*, 17*b*) in a spaced relationship from a connected position with a ground terminal fitting (10) towards draw-out positions on an outer surface (21) of a resin molding (20). The wires (17*a*, 17*b*) are drawn out at spaced apart positions on the outer surface (21) of the molding resin (20). Thus, the molding resin (20) is adhered to the outer surfaces of the wires (17*a*, 17*b*) over the entire circumferences. Accordingly, no clearance is left between the wires (17*a*, 17*b*) and the molding resin (20), and high waterproof performances can be displayed.

7 Claims, 8 Drawing Sheets

WATERPROOF CONSTRUCTION FOR A GROUND TERMINAL FITTING, A METHOD AND AN APPARATUS FOR WATERPROOFING A GROUND TERMINAL FITTING

BACKGROUND OF THE INVENTION

1. Field of the Invention

The invention relates to a waterproof construction for a ground terminal fitting, a method and an apparatus for waterproofing a ground terminal fitting.

2. Description of the Related Art

U.S. Pat. No. 6,613,263 discloses a construction for grounding a plurality of wires by bundling the wires together, crimping the bundled wires to one ground terminal fitting and then fixing the ground terminal fitting to a grounding member.

A connected portion between the above-described ground terminal fitting and the wires is surrounded by a molding resin to prevent water from entering into cores of the wires. More particularly, as shown in FIG. 8, wires 100 are bundled and drawn out from a resin mold 101. The lateral cross section of each wire 100 is substantially circular. Thus, clearances between the adjacent wires 100 have a shape of a pinnacle in section. It is difficult to fill the resin into such pinnacle-shaped narrow clearances 102, and tiny clearances 103 are left between the adjacent wires 100 after molding. Thus, water can enter the inside of the resin mold 101 through the clearances 103.

The present invention was developed in view of the above problem, and an object thereof is to prevent water from entering into a resin mold that surrounds a connected portion between a ground terminal fitting and wires.

SUMMARY OF THE INVENTION

The invention relates to a waterproof construction for a terminal fitting, preferably a ground or battery terminal fitting, for connecting a plurality of bundled wires together with the terminal fitting by surrounding a connected portion of the wires and the terminal fitting by a molding resin. The wires are spaced apart from each other from a connected position with the terminal fitting towards draw-out positions on an outer surface of the molding resin, and the respective wires are drawn out at spaced-part positions on the outer surface of the molding resin. As a result, the molding resin is adhered to the entire outer surface of each wire over the entire circumferences. Accordingly, no clearance exists between the wires and the molding resin, and high waterproof performances can be displayed.

The wires preferably are spaced apart from each other along a direction substantially normal to a longitudinal direction of ends of the wires connected with each other.

The terminal fitting preferably comprises a connecting portion for connection to an external portion such as a battery post or ground and/or for connection to another terminal fitting. The terminal fitting also comprises an extending portion that includes a wire connection portion. At least part of the wire connecting portion preferably is covered by the molding resin.

The invention also relates to a method for waterproofing a connection between a plurality of wires and a ground terminal fitting. The method comprises connecting the wires to at least one ground terminal fitting. The method then comprises surrounding a connected portion between the wires and the ground terminal fitting by a molding resin. More particularly, a wire holding means is provided in a mold. The wires then are placed in the wire holding means so that the wires are spaced apart from each other from a connected position with the ground terminal fitting towards draw-out positions on an outer surface of the molding resin. The molding then is carried out so that the wires are at spaced-part positions on the outer surface of the molding resin in an already molded state.

The method may further comprise detachably mounting at least one jig of the wire holding means in the mold for molding. The step of mounting the jig preferably comprises selecting a jig having wire holding portions suitable for the wires connected with the terminal fitting. The jig may become integral to the molding resin in the molding process.

The invention also relates to apparatus for waterproofing a connection between a terminal fitting and a plurality of wires by surrounding a connected portion between the wires and the terminal fitting by a molding resin. The apparatus comprises a mold and a wire holding means for holding the wires in the mold. The wiring holding means spaces the wires apart from a connected position with the ground terminal fitting towards draw-out positions on an outer surface of the molding resin. Thus, the wires are drawn out at spaced-part positions on the outer surface of the molding resin.

The wire holding means preferably comprises a jig detachably mountable in the mold. Thus, wires having different outer diameters can be accommodated merely by exchanging the jig in a common mold. Accordingly, costs can be reduced as compared to a case where the entire mold is exchanged in accordance with the outer diameters of the wires.

The jig preferably has wire holding portions with shapes suitable for the respective wires connected with the terminal fitting.

These and other features of the invention will become more apparent upon reading the following detailed description and accompanying drawings. It should be understood that even though embodiments are described separately, single features thereof may be combined to additional embodiments.

DETAILED DESCRIPTION OF THE PREFERRED EMBODIMENTS

Figure 1:
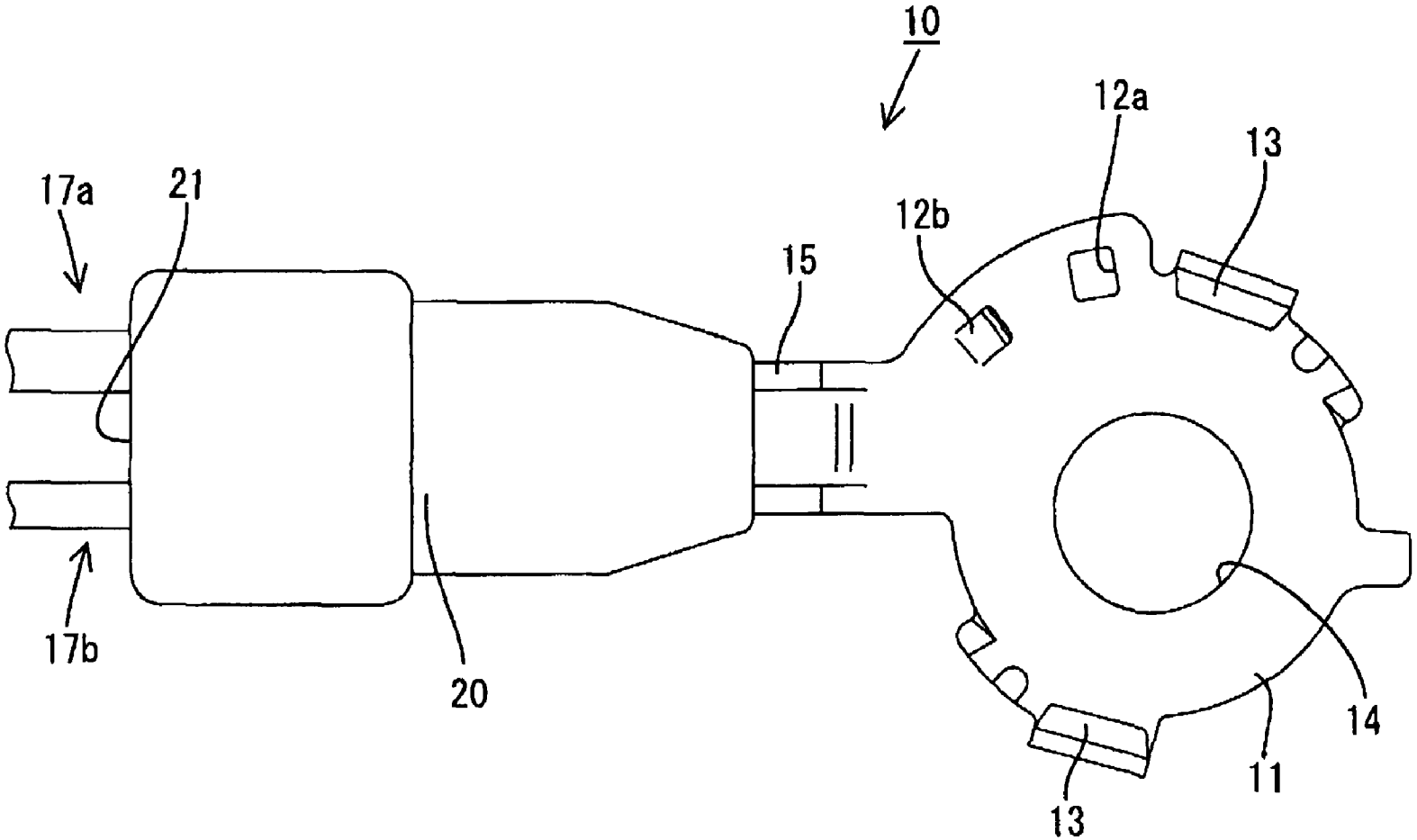
FIG. 1 is a plan view of a ground terminal fitting according to one embodiment of the invention.
Figure 2:
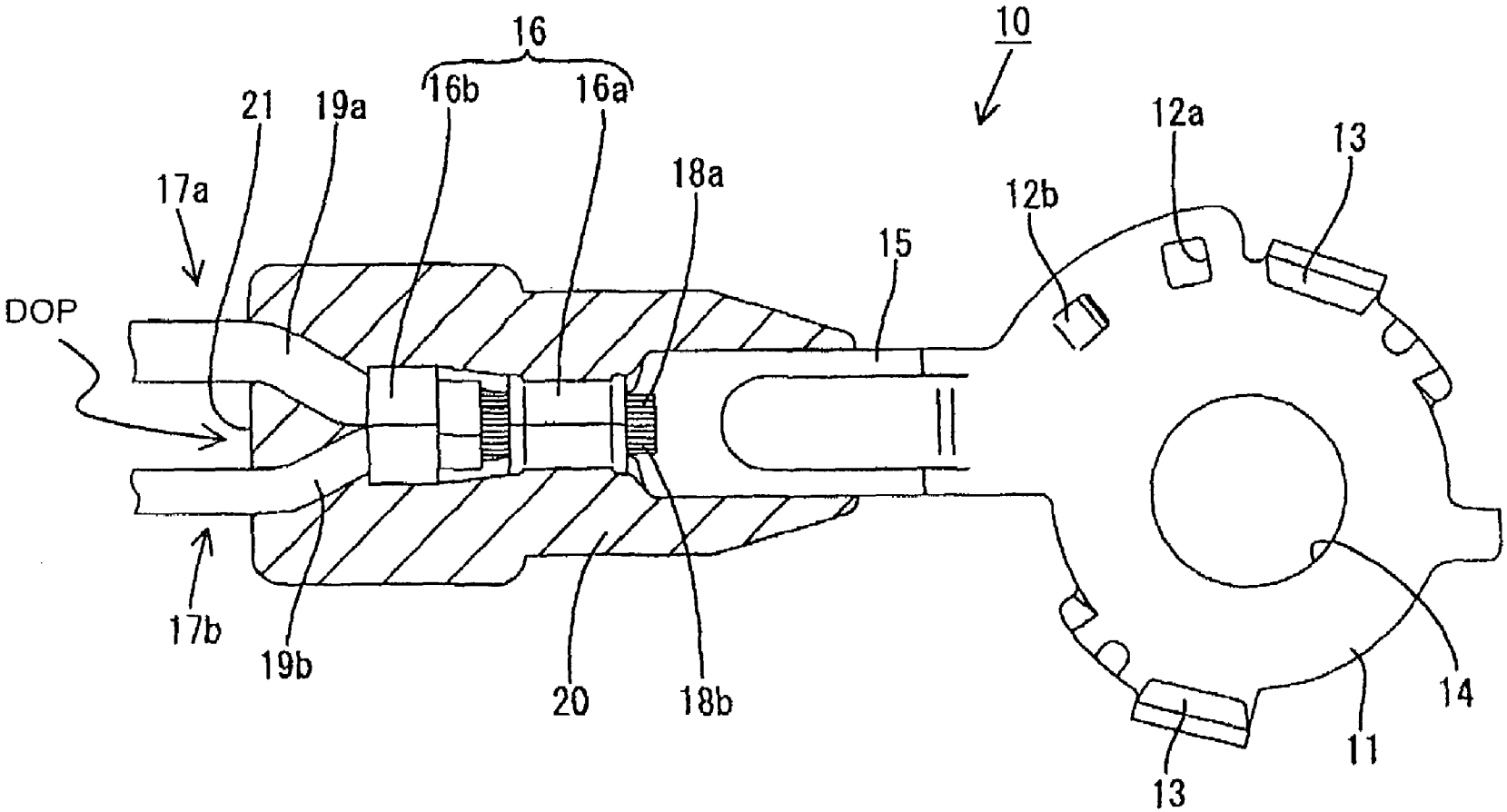
FIG. 2 is a horizontal section of the ground terminal fitting.
Figure 3:
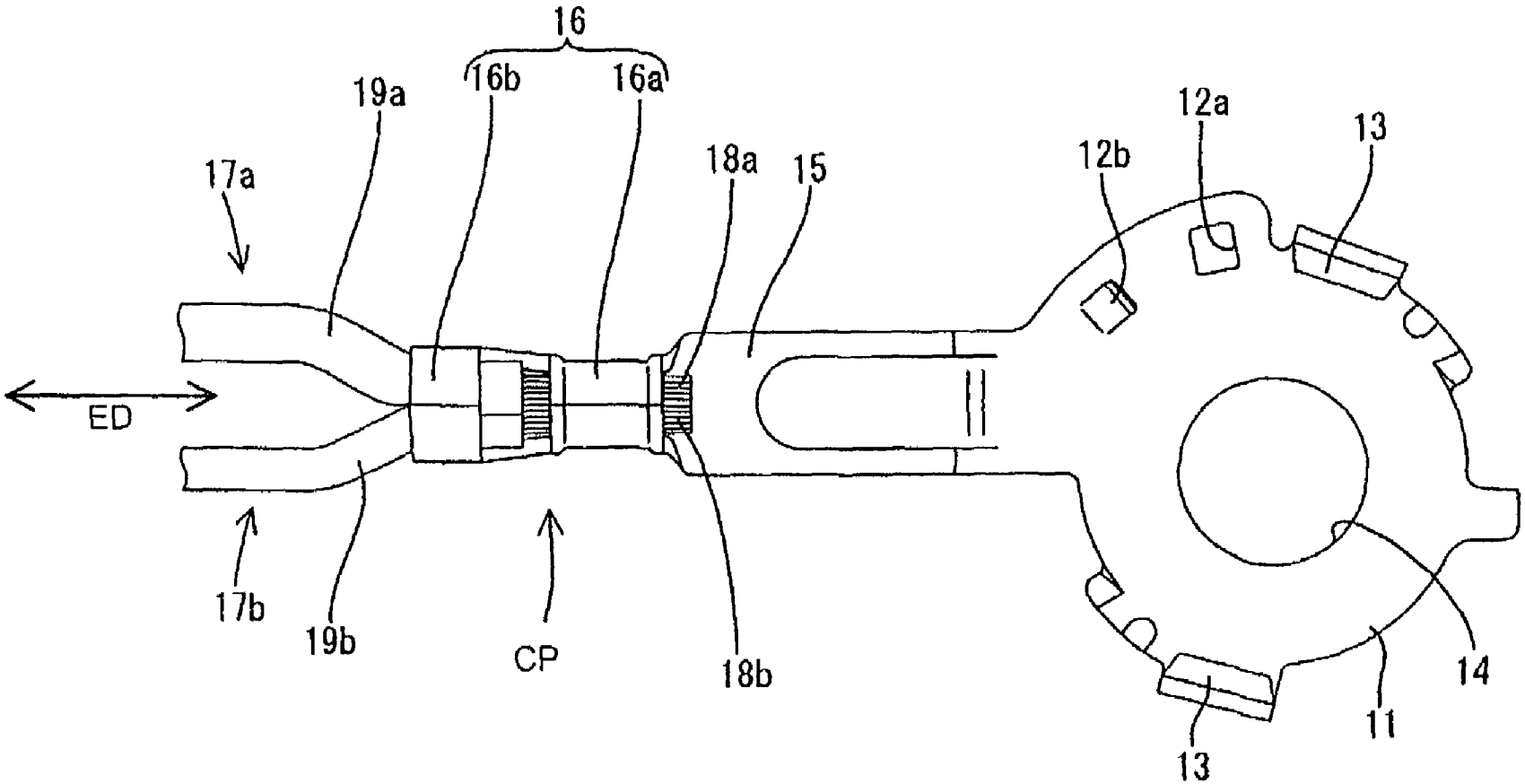
FIG. 3 is a plan view showing wires are connected with the ground terminal fitting.

A battery or ground terminal fitting according to the invention is identified by the numeral 10 in FIGS. 1 to 7. The terminal fitting 10 is formed, for example, by bending, folding and/or embossing a conductive metallic plate material-stamped or cut out into a specified shape. More particularly, the terminal fitting 10 includes a substantially ringshaped connecting plate 11 and an extension 15 projecting substantially radially out from the outer periphery of the connecting plate 11 and substantially flush with the connecting plate 11.

A locking hole 12*a* penetrates the connecting plate 11 substantially normal to the plane of the connecting plate 11. At least one locking piece 12*b* is formed by cutting the connecting plate 11 and bending a cut section out of the plane of the connecting plate 11. Two pressing pieces 13 project up from the outer periphery of the connecting plate 11. Connecting plates 11 of two ground terminal fittings 10 can be placed concentrically placed over one another so that the locking hole 12*a* of the upper connecting plate 11 and the locking piece 12*b* of the lower connecting plate 11 interlock to prevent relative circumferential movements of the connecting plates 11. Additionally, the outer periphery of the upper connecting plate 11 is held axially between the lower connecting plate 11 and the pressing pieces 13 thereof to prevent the connecting plates 11 from being separated axially. In this way, the two ground terminal fittings 10 are coupled to each other with the extensions 15 thereof circumferentially displaced and with center holes 14 substantially concentrically aligned. A bolt (not shown) of a grounding member (not shown) for grounding the ground terminal fittings 10 or a battery post of a battery (not shown) for connecting the battery terminal fittings 10 is inserted into the center holes 14.

A wire connection portion is formed near the extending end of the extension 15 and has a known crimping portion 16 with crimping pieces that project up from opposite edges of a bottom plate. The crimping portion 16 includes a wire barrel 16*a* near the connecting plate 11 and an insulation barrel 16*b* farther from the connecting plate 11 and at the extending end of the extension 15.

The crimping portion 16 is crimped, bent or folded into connection with ends of two wires 17*a*, 17*b* having different outer diameters. The respective wires 17*a*, 17*b* have cores 18*a*, 18*b* covered by resin insulation coatings 19*a*, 19*b*. The insulation coatings 19*a*, 19*b* are stripped to expose the cores 18*a*, 18*b* at the ends of the respective wires 17*a*, 17*b*. The wires 17*a*, 17*b* are placed substantially side-by-side in close contact with each other on the bottom plate of the crimping portion 16 so that their longitudinal axes are substantially parallel, and are secured by the crimping pieces of the crimping portion 16. Thus, the ends of the insulation coatings 19*a*, 19*b* of the two wires 17*a*, 17*b* are secured to the insulation barrel 16*b* while being held side-by-side in close contact. Similarly, the two exposed cores 18*a*, 18*b* are secured to the wire barrel 16*a* while being held side by side in close contact. The two wires 17*a*, 17*b* secured to the crimping portion 16 extend from the extending end of the extension 15 substantially in the same direction as the extending direction ED of the extension 15. Thus, the wires 17*a*, 17*b* are spaced from each other in a direction lying in the plane of the draw-out surface 21.

A connected portion CP of the ground terminal fitting 10 and the wires 17*a*, 17*b* is to be surrounded by a molding resin 20 for waterproofing. The molding resin 20 surrounds most of the extension 15 excluding a coupling end to the connecting plate 11, but including substantially the entire connected portion CP with the wires 17*a*, 17*b*. The wires 17*a*, 17*b* are drawn out of the molding resin 20 at laterally spaced-apart positions through a draw-out surface 21 at a side of the molding resin 20 substantially opposite the connecting plate 11. The draw-out direction is substantially parallel with the longitudinal direction of the ends of the wires 17*a*, 17*b* connected with the crimping portion 16 and parallel with the extending direction ED of the extension 15.

As described above, the two wires 17*a*, 17*b* are held side-by-side in close contact at their portions connected with the ground terminal fitting 10, whereas they are drawn out on the draw-out surface 21 of the molding resin 20 at positions spaced apart laterally along a direction substantially normal to the extending direction ED. To realize this arrangement, the two wires 17*a*, 17*b* are arranged obliquely and away from each other from the crimping portion 16 towards the draw-out surface 21 of the molding resin 20. The wires 17 preferably are spaced from each other by more than about ⅕ of the wire diameter.

The extension 15 of the ground terminal fitting 10 and the ends of the wires 17*a*, 17*b* are set in a cavity 25 of a mold 22 after the two wires 17*a*, 17*b* are connected. The mold 22 is opened and closed by moving an upper mold 24 with respect to a lower mold 23. A jig 26 is detachably mounted in the lower mold 23. A surface of the jig 26 facing the cavity 25 serves as a molding surface 27 for forming a part of the draw-out surface 21 of the molding resin 20. Substantially semicircular large and small holding grooves 28*a*, 28*b* are formed substantially parallel with each other along the extending direction ED in the upper surface of the jig 26. The holding grooves 28*a*, 28*b* communicate with the cavity 25 and have cross-sections substantially conforming to part of an outer shape of the wires 17*a*, 17*b*. Inner diameters of the holding grooves 28*a*, 28*b* substantially equal the outer diameters of the two wires 17*a*, 17*b*. Fitting grooves 29*a*, 29*b* having the substantially same dimensions and shape as the holding grooves 28*a*, 28*b* are formed in the upper surface of the lower mold 23 and concentrically communicate with the holding grooves 28*a*, 28*b*.

The upper mold 24 also is formed with a jig 30. The jig 30 of the upper mold 24 has a substantially vertically symmetrical shape with respect to the jig 26 of the lower mold 23 and includes a molding surface 31 substantially continuous and flush with the molding surface 27 of the lower mold 23. Substantially semicircular holding grooves 32*a*, 32*b* are provided in the upper mold 24 and substantially correspond to the holding grooves 28*a*, 28*b* of the lower mold 23. Thus, the holding grooves 28*a*, 28*b* have substantially semicircular cross sections. No further description is given thereon. Further, fitting grooves 33*a*, 33*b* are formed in the lower surface of the upper mold 24 and substantially correspond to the fitting grooves 29*a*, 29*b* of the lower mold 23. Thus, the fitting grooves 33*a*, 33*b* have substantially semicircular cross sections conforming to part of an outer shape of the wires 17*a*, 17*b*.

Figure 4:
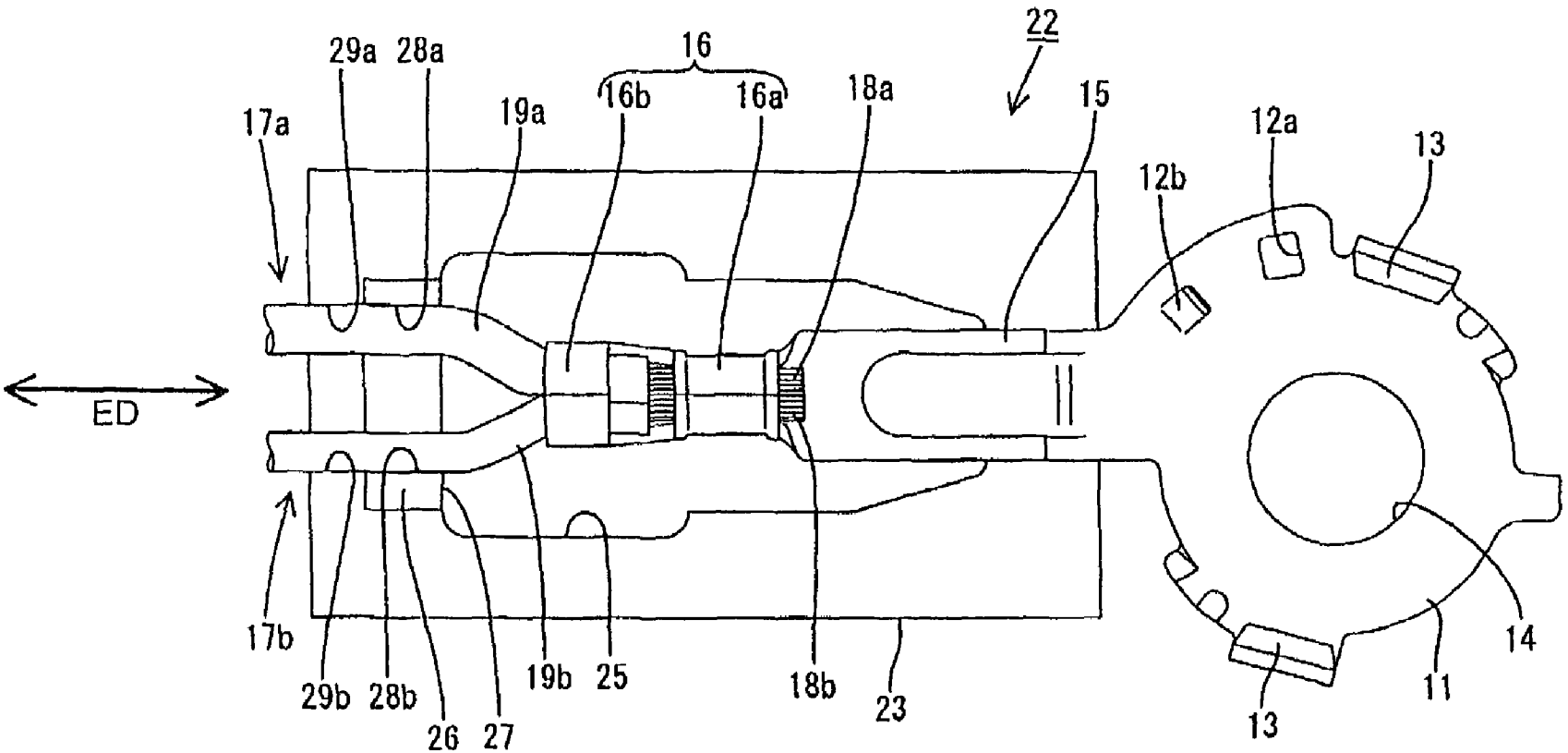
FIG. 4 is a plan view showing a state where the ground terminal fitting having the wires connected therewith is set in a mold for molding.
Figure 5:
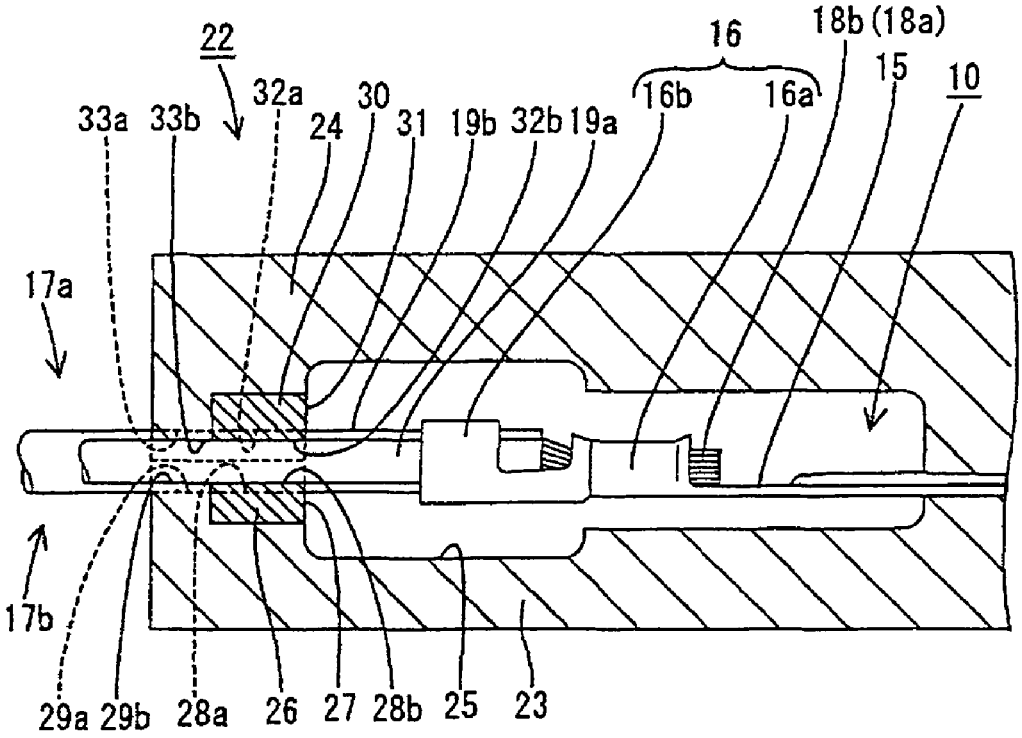
FIG. 5 is a partial longitudinal section showing the closed mold.
Figure 6:
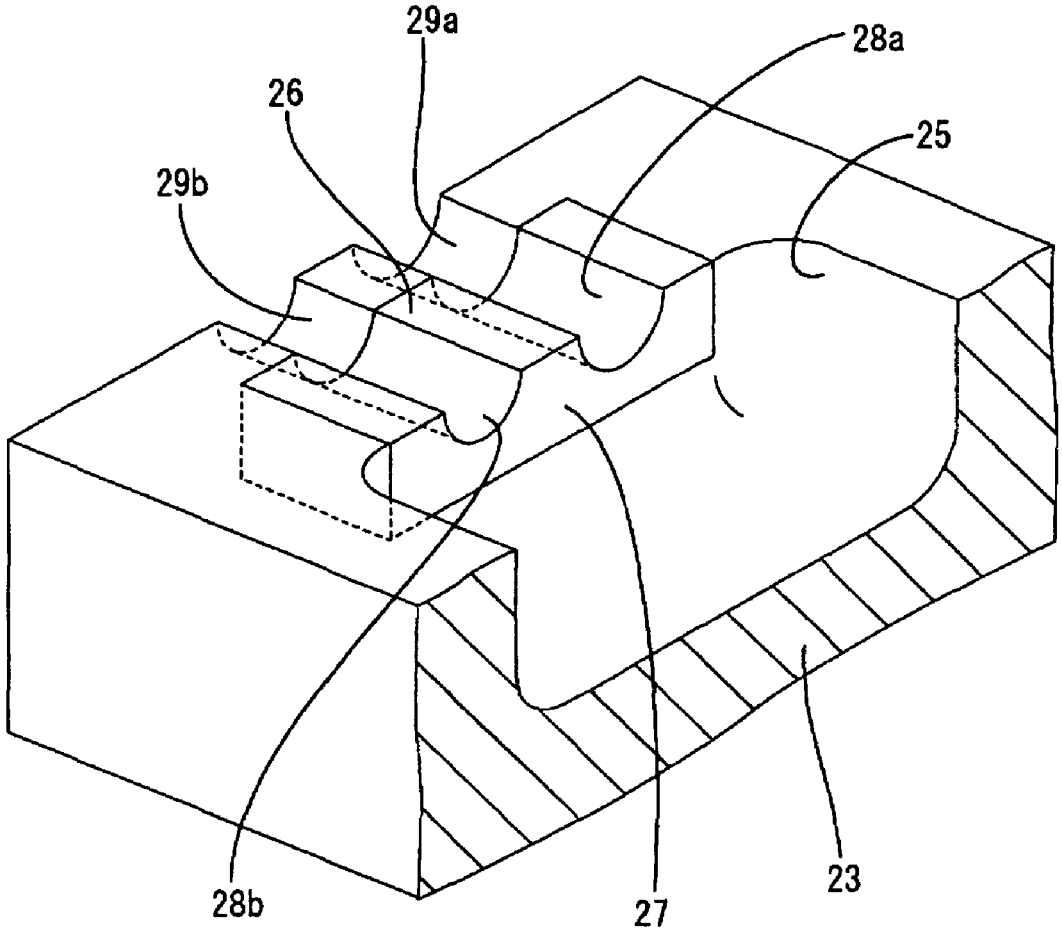
FIG. 6 is a perspective view of the mold and a wire holding means.
Figure 7:
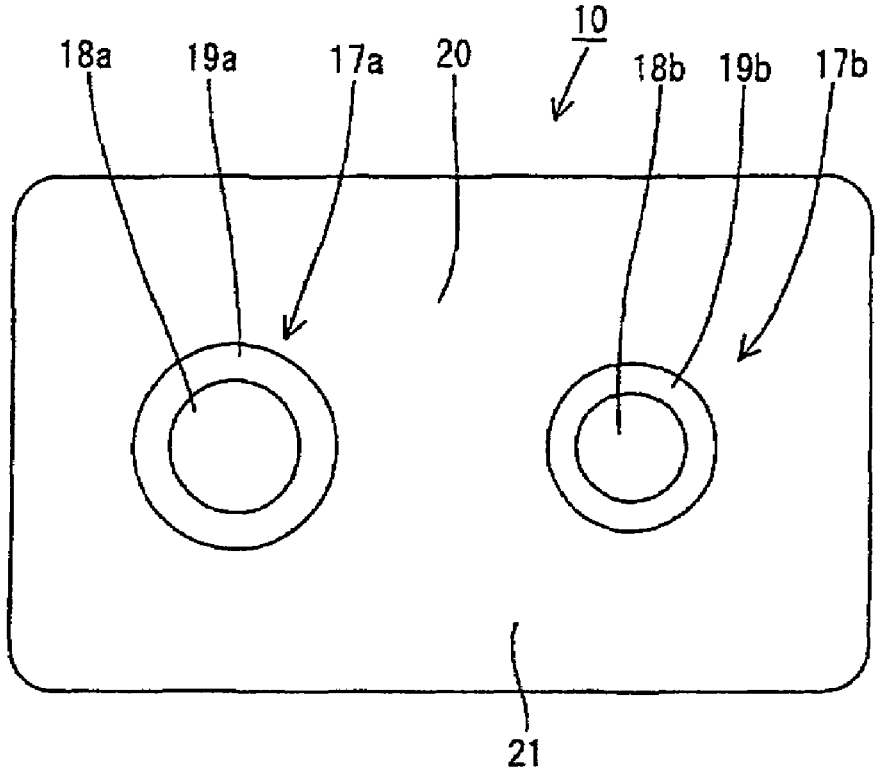
FIG. 7 is an end view showing wire draw-out positions on an outer surface of a molding resin.
Figure 8:
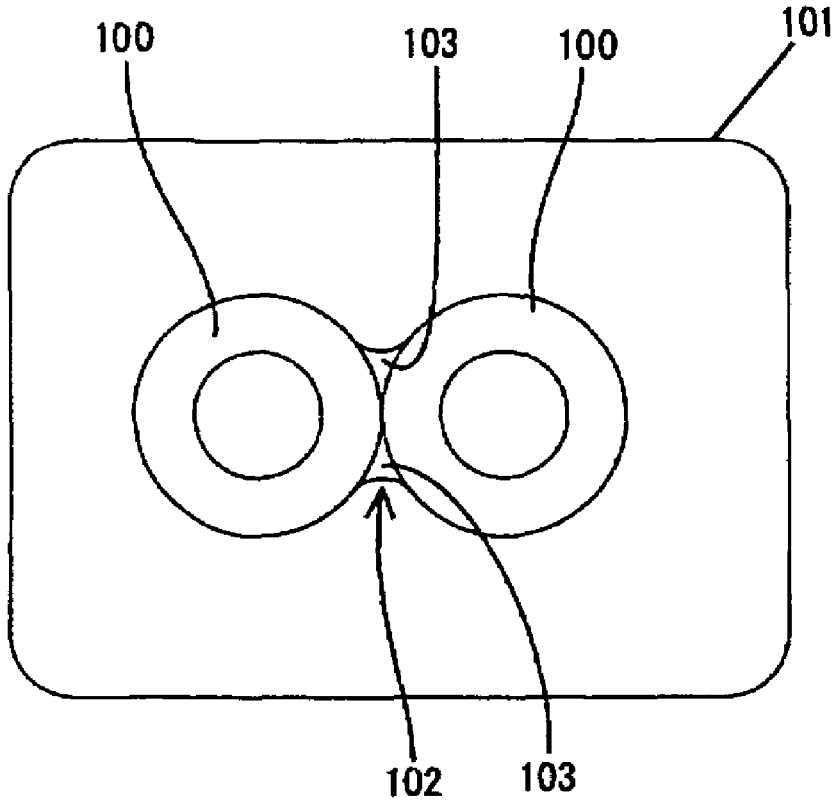
FIG. 8 PRIOR ART
FIG. 8 is an end view showing wire draw-out positions on an outer surface of a molding resin in a prior art waterproof construction.

The ground terminal fitting 10 and ends of the wires 17*a*, 17*b* are set in the cavity 25 of the lower mold 23 with the mold 22 opened (see FIG. 4). At this time, the wires 17*a*, 17*b* are fit in the corresponding holding grooves 28*a*, 28*b* and fitting grooves 29*a*, 29*b*. Thus, the wires 17*a*, 17*b* are positioned away from each other from the crimping portion 16 towards the jig 26 in the cavity 25. The mold 22 then is closed by moving at least one of the molds 23 and 24 with respect to the other. Thus, laterally spaced sections of the two wires 17*a*, 17*b* are held in holes formed by the upper and lower holding grooves 28*a*, 32*a*, 38*b*, 32*b* and the upper and lower fitting grooves 29*a*, 33*a*, 29*b*, 33*b*.

Molten resin then is filled in the cavity 25 and solidified. Accordingly, the molding resin 20 defines an integral matrix surrounding and engaging the connected portion of the ground terminal fitting 10 and the wires 17*a*, 17*b*. In this way, waterproofing to the ground terminal fitting 10 is completed.

As described above, two wires 17*a*, 17*b* are bundled and connected together with the ground terminal fitting 10, and this connected portion CP is surrounded by the molding resin 20. The wires 17*a*, 17*b* are spaced from each other from the connected position CP with the ground terminal fitting 10 towards the draw-out surface 21 of the molding resin 20 and are drawn out at the spaced-apart positions on the draw-out surface 21 of the molding resin 20. The molding resin 20 adheres to the outer surfaces of the wires 17*a*, 17*b* over substantially the entire circumferences. Thus, no clearance is left between the wires 17*a*, 17*b* and the molding resin 20, and high waterproof performances can be displayed.

The wire holding means includes jigs 26, 30 detachably mounted in the mold 22. Thus, wires 17*a*, 17*b* of different outer diameters can be accommodated merely by exchanging the jigs 26, 30 in the common mold 22, so that jigs 26, 30 corresponding to outer diameters of the wires 17*a*, 17*b* are employed. Accordingly, costs can be reduced as compared to a case where the entire mold 22 is exchanged to match outer diameters of the wires 17*a*, 17*b*.

The invention is not limited to the above described and illustrated embodiment. For example, the following embodiments also are embraced by the technical scope of the invention as defined by the claims. Beside the following embodiments, various changes can be made without departing from the scope and spirit of the present invention as defined by the claims.

Wires having different outer diameters are connected in the foregoing embodiment. However, the invention is also applicable to a case where wires having the same outer diameter are connected.

Two wires are connected in the foregoing embodiment. However, three or more wires may be connected. In such a case, wire draw-out positions on the outer surface of the molding resin may align the wires in a row, or may provide an offset arrangement of the wires.

Two ground terminal fittings are coupled in the foregoing embodiment. However, the invention also applies to a case where a ground terminal fitting is not coupled to another ground terminal fitting.

The wire connecting means of the foregoing embodiment has a crimping portion with open barrels. However, the invention also applies to a crimping portion with closed barrels or by another connecting means, such as insulation-displacement portions, soldered portions, welded portions, etc.

The wire holding means is detachably mountable in the mold in the foregoing embodiment, but may be integrally or unitarily formed in the mold.

The wires are drawn out substantially in parallel from the outer surface of the molding resin in the foregoing embodiment. However, they may be drawn in different directions from the outer surface of the molding resin.

The ground terminal fitting has only one connected portion with the wires in the foregoing embodiment, but may have more connected portions.

The jigs are separated from the wires after molding in the foregoing embodiment. However, the jigs may become integral to the molding resin according to the invention. In short, the jig may be set in the cavity of the mold for molding to be partly or entirely embedded in the molding resin.

What is claimed is:

1. A waterproof construction comprising:

a terminal fitting having a connecting portion for connection to an external member, an extension extending from the connecting portion and a wire connection portion extending from the extension;

a plurality of bundled wires connected together with the wire connection portion of the terminal fitting to define a connected portion of the wires with the terminal fitting, the wires diverging from one another and being spaced apart from each other at location spaced from the connected portion of the wires with the terminal fitting; and a molding resin surrounding the extension of the terminal fitting, the connected portion of the wires with the terminal fitting and the diverging and spaced apart portions of the wires spaced from the terminal fitting.

2. A method for waterproofing a connection of a plurality of wires with a single terminal fitting, comprising:

arranging the wires in a wire holding means provided in a mold so that the wires diverge from each other from a connected portion with the terminal fitting towards draw-out positions where the wires are spaced from the terminal fitting and spaced from one another; and applying a molding resin for surrounding both the connected portion of the wires with the terminal fitting and at least the diverging portions of the wires, so that the wires are drawn out at spaced-apart positions on an outer surface of the molding resin in an already molded state.

3. The method of claim 2, further comprising a step of detachably mounting at least one jig of the wire holding means in the mold.

4. The method of claim 3, wherein the step of mounting the jig comprises a step of selecting a jig having wire holding portions suitable for the respective wires connected with the terminal fitting.

5. The method of claim 3, further comprising forming the molding resin unitarily around at least portions of the jig so that the jig becomes integral to the molding resin in the molding process.

6. An apparatus for waterproofing at least one terminal fitting connected with a plurality of substantially bundled wires by surrounding a connected portion of the wires and the terminal fitting by a molding resin, comprising:

a mold; and a wire holding means for holding the wires so that the wires are spaced apart from each other from a connected position with the terminal fitting towards draw-out positions on an outer surface of the molding resin, the wire holding means including a jig detachably mounted in the mold, whereby the respective wires are drawn out at spaced-part positions on the outer surface of the molding resin in an already molded state.

7. The apparatus of claim 6, wherein the jig has wire holding portions having shapes suitable for the respective wires connected with the terminal fitting.

* * * * *